US009811966B2

(12) United States Patent
Liu et al.

(10) Patent No.: US 9,811,966 B2
(45) Date of Patent: Nov. 7, 2017

(54) DISPENSING ASSEMBLY IN VENDING MACHINE

(71) Applicants: HONG FU JIN PRECISION INDUSTRY (WuHan) CO., LTD., Wuhan (CN); HON HAI PRECISION INDUSTRY CO., LTD., New Taipei (TW)

(72) Inventors: Chao Liu, Wuhan (CN); Zhi-Ping Wu, Wuhan (CN); Ting-Ting He, Wuhan (CN)

(73) Assignees: HONG FU JIN PRECISION INDUSTRY (WuHan) CO., LTD., Wuhan (CN); HON HAI PRECISION INDUSTRY CO., LTD., New Taipei (TW)

( * ) Notice: Subject to any disclaimer, the term of this patent is extended or adjusted under 35 U.S.C. 154(b) by 513 days.

(21) Appl. No.: 14/138,207

(22) Filed: Dec. 23, 2013

(65) Prior Publication Data

US 2014/0291349 A1 Oct. 2, 2014

(30) Foreign Application Priority Data

Mar. 29, 2013 (CN) ..... 2013 1 01073414

(51) Int. Cl.
*G07F 11/24* (2006.01)
*A47F 1/08* (2006.01)

(52) U.S. Cl.
CPC ..... *G07F 11/24* (2013.01); *A47F 1/08* (2013.01)

(58) Field of Classification Search
CPC ..... G07F 11/04; G07F 11/24
See application file for complete search history.

(56) References Cited

U.S. PATENT DOCUMENTS 4,423,828 A * 1/1984 Tanaka ..... G07F 11/10 221/129
4,542,834 A * 9/1985 Kurosawa ..... G07F 11/16 221/116
4,565,300 A * 1/1986 Kokubun ..... G07F 11/10 221/116
4,574,980 A * 3/1986 Kurosawa ..... G07F 11/24 221/116
4,673,105 A * 6/1987 Kurosawa ..... G07F 11/16 221/281

(Continued)

*Primary Examiner* — Gerald McClain
*Assistant Examiner* — Kelvin L Randall, Jr.
(74) *Attorney, Agent, or Firm* — Steven Reiss

(57) ABSTRACT

A dispensing assembly includes a mounting plate with a plurality of openings, a rotatable shaft located adjacent to the mounting plate, a plurality of blocking plates pivotably attached to the mounting plate, and a plurality of jacking members attached to the rotatable shaft. Lengths of the plurality of jacking members are different from each other. When the shaft is rotated to an initial position, the plurality of jacking members disengages away from the plurality of blocking plates, and the plurality of blocking plates are received in the plurality of openings. When the shaft is rotated to a working position, the plurality of blocking plates is rotated out of the plurality of openings to positions slanted relative to the mounting plate by the plurality of jacking members. Slanting angles of the plurality of blocking plates relative to the mounting plate are different from each other.

10 Claims, 9 Drawing Sheets

(56) References Cited

U.S. PATENT DOCUMENTS

| | | | | | |
|---|---|---|---|---|---|
| 4,676,398 | A | * | 6/1987 | Kokubun | G07F 11/24 221/129 |
| 4,776,487 | A | * | 10/1988 | Kurosawa | G07F 11/24 221/116 |
| 4,854,477 | A | * | 8/1989 | Kurosawa | G07F 11/24 221/1 |
| 5,799,824 | A | * | 9/1998 | Gasiel | G07F 11/16 221/112 |

* cited by examiner

DISPENSING ASSEMBLY IN VENDING MACHINE

This application is related to co-pending application Ser. No. 13/953,664, entitled, "DISPENSING ASSEMBLY IN VENDING MACHINE."

BACKGROUND

1. Technical Field

The present disclosure relates to vending machines, and particularly to a dispensing assembly in the vending machines.

2. Description of Related Art

A dispensing assembly for dispensing commodities includes a bracket, a tray, and a shaft. The bracket includes a base for the placement of the commodities. The tray is located under the base. The tray is secured to the shaft. The shaft is rotatable under an action of a motor to rotate the tray to hold the base or release the base. When the tray supports the base, the commodities are blocked by the base and cannot drop down for the customer to retrieve. When the tray releases the base, the base is free, causing one item to drop down to the bin with gravity. Generally, the shaft is inserted in a plurality of shaft sleeves, and then the shaft sleeves are secured to the bracket by screws or latches. However, the securing process of the shaft is time-consuming, and a securing structure of the shaft can be complicated and costly. Therefore, there is room for improvement in the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

Figure 1:
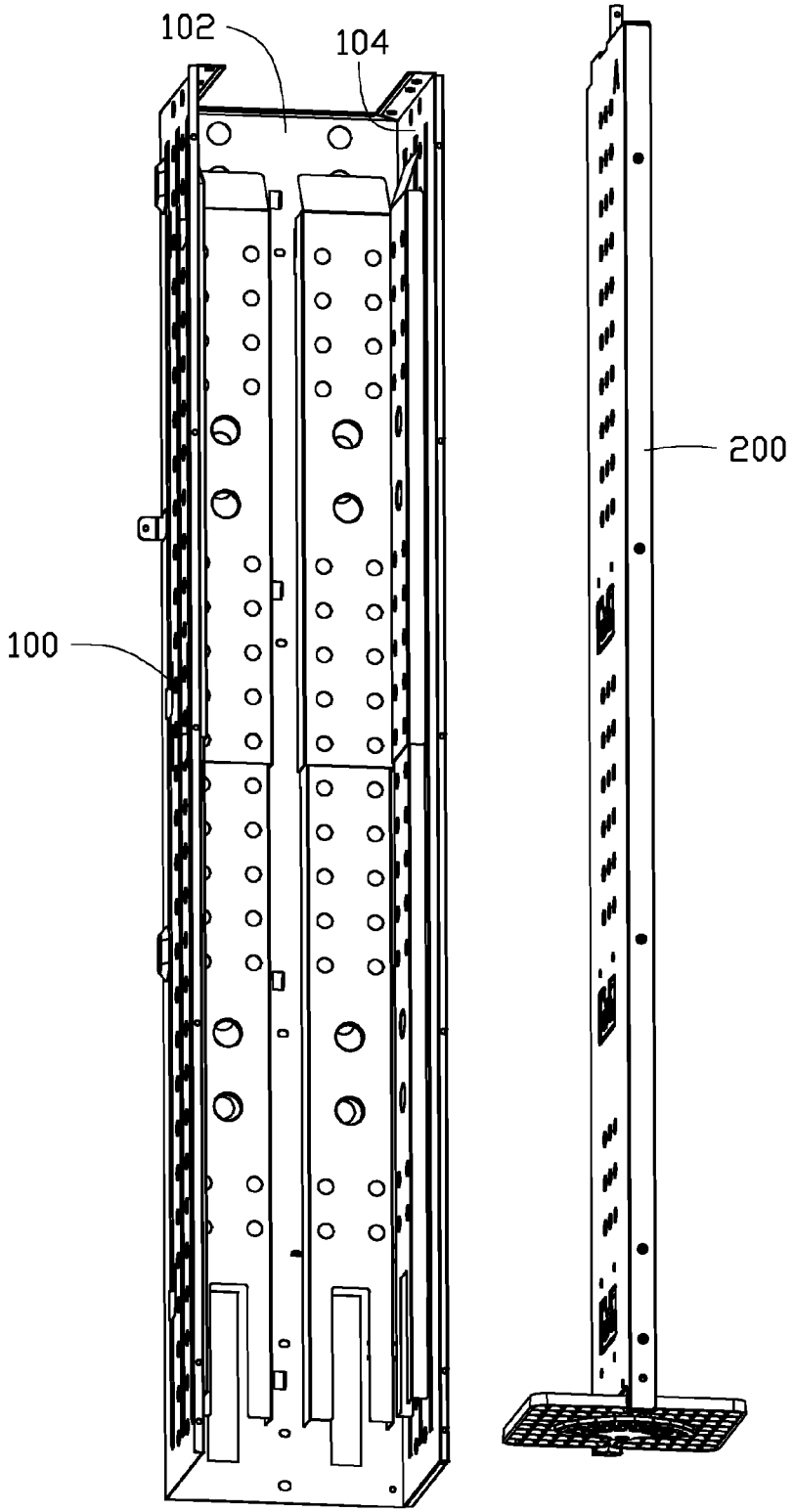
FIG. 1 is an exploded, isometric view of one embodiment of a dispensing assembly.
Figure 2:
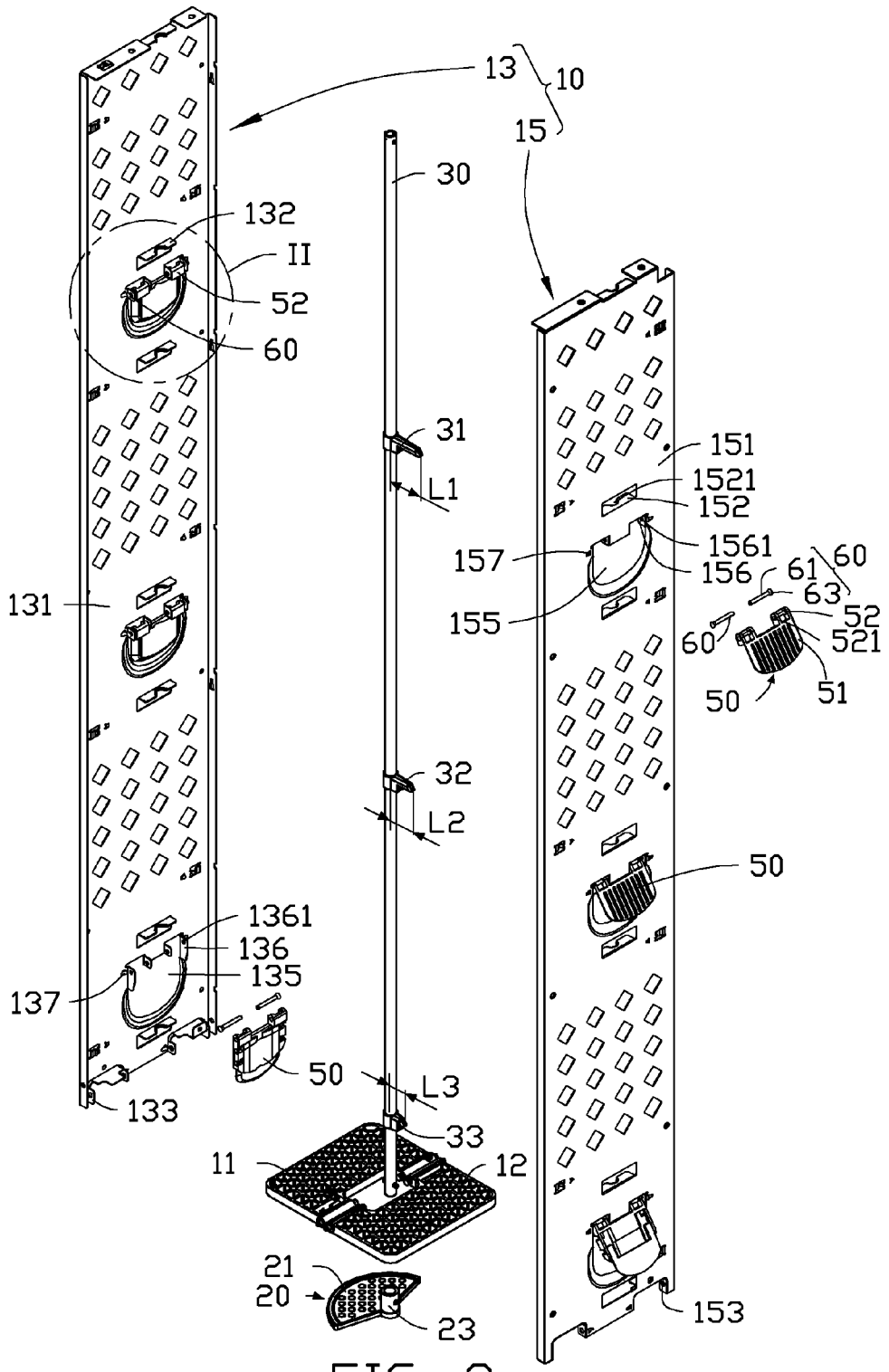
FIG. 2 is an exploded view of a control device of the dispensing assembly of FIG. 1.

FIGS. 1 and 2 show one embodiment of a dispensing assembly. The dispensing assembly includes casing 100 and a control device 200. The casing 100 includes a first side plate 102 and a pair of second side plates 104 extending substantially perpendicularly from opposite sides of the first side plate 102. The control device 200 includes a bracket 10, a first base 11, a second base 12, a tray 20, a shaft 30, and a plurality of blocking plates 50.

The bracket 10 includes a first frame 13 and a second frame 15.

The first frame 13 includes a first mounting plate 131 and a plurality of first limiting pieces 132, extending substantially perpendicularly from an inner side of the first mounting plate 131. A length of the first mounting plate 131 is substantially equal to that of the first side plate 102. A width of the first mounting plate 131 is substantially equal to that of each second side plate 104. A first cutout 1321 is defined in each first limiting piece 132. Two pairs of first pivoting pieces 133 extend substantially perpendicularly from a lower portion of the first mounting plate 131. Each first pivoting piece 133 is substantially perpendicular to the plurality of first limiting pieces 132. A plurality of first openings 135 is defined in the first mounting plate 131. Two pairs of first positioning pieces 136 extend from edges of each first opening 135. A first positioning hole 1361 is defined in each first positioning piece 136. A first protrusion 137 extends from the inner side of the first mounting plate 131 and is positioned adjacent to each pair of first positioning pieces 136. In one embodiment, the first cutout 1321 is semicircular.

A shape and size of the second frame 15 is similar to that of the first frame 13. The second frame 15 includes a second mounting plate 151 and a plurality of second limiting pieces 152, extending substantially perpendicularly from an inner side of the second mounting plate 151. A second cutout 1521 is defined in each second limiting piece 152. Two pairs of second pivoting pieces 153 are located at a lower portion of the second mounting plate 151. Each second pivoting piece 153 is substantially perpendicular to the second mounting plate 151. A plurality of second openings 155 is defined in the second mounting plate 151. Two pairs of second positioning pieces 156 extend from edges of each second opening 155. A second positioning hole 1561 is defined in each second positioning piece 156. A second protrusion 157 extends from the second mounting plate 151 and located adjacent to each pair of second positioning pieces 156. In one embodiment, the second cutout 1521 is semicircular.

The tray 20 includes a support plate 21 and a mounting post 23 located on the support plate 21. In one embodiment, the support plate 21 is a section of a circle with an interior angle smaller than 180 degrees, which is less than a full semicircle.

A first jacking member 31, a second jacking member 32, and a third jacking member 33 are attached to the shaft 30. The second jacking member 32 is located below the first jacking member 31. The third jacking member 33 is located below the second jacking member 32. The second jacking member 32 is located at a central portion between the first jacking member 31 and the third jacking member 33. Each of the first jacking member 31, the second jacking member 32, and the third jacking member 33 extends along a direction substantially perpendicular to an axial direction of the shaft 30. A first distance L1 is defined between a distal end of the first jacking member 31 and an axis of the shaft 30. A second distance L2 is defined between a distal end of the second jacking member 32 and the axis of the shaft 30. A third distance L3 is defined between a distal end of the third jacking member 33 and the axis of the shaft 30. In one embodiment, the second distance L2 is less than the first distance L1, but greater than the third distance L3.

Each blocking plate 50 includes a plate body 51 and two positioning portions 52 extending from the plate body 51. A through hole 521 is defined in each positioning portion 52.

The dispensing assembly further includes a plurality of bolts 60. Each bolt 60 includes an inserting portion 61 and a blocking portion 63. In one embodiment, a cross section of the blocking portion 63 is circular, and the through hole 521 is circular. A diameter of the blocking portion 63 is smaller than a diameter of the through hole 521.

Figure 3:
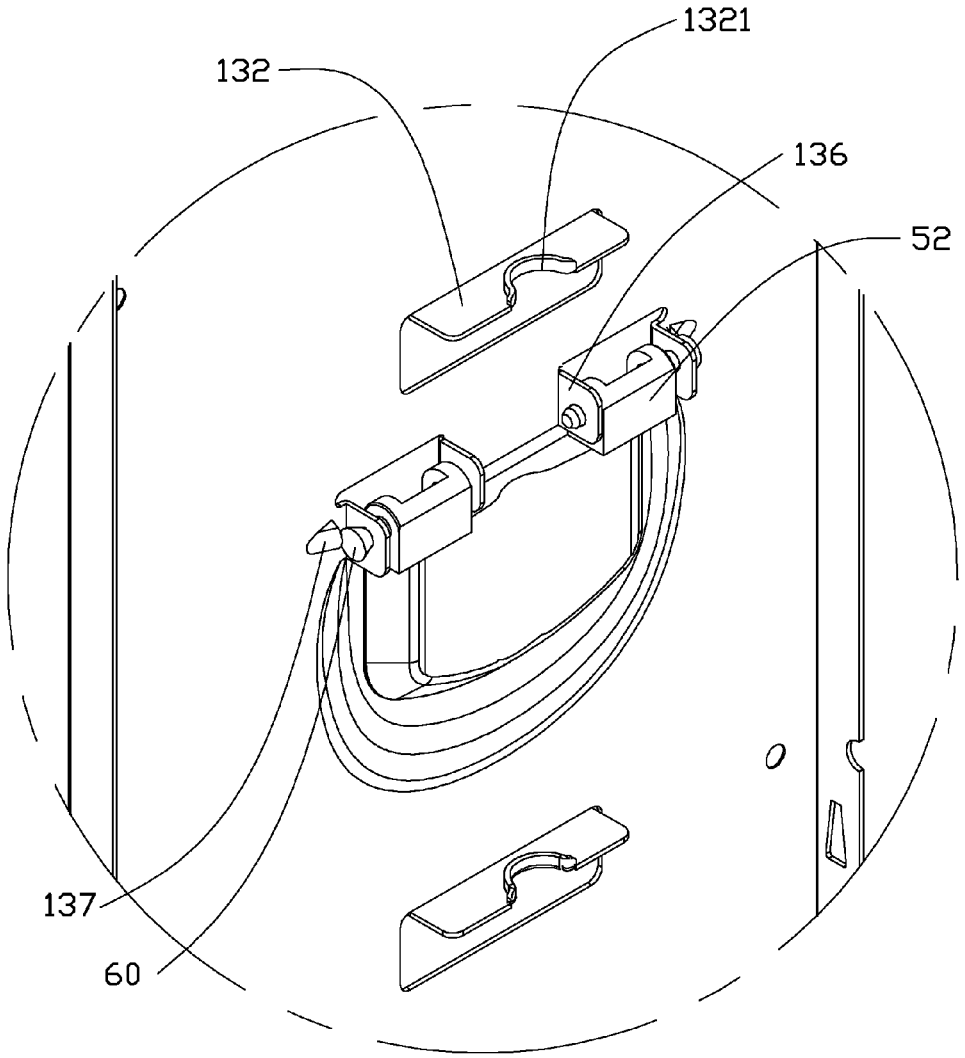
FIG. 3 is an enlarged view of a circled portion II of FIG. 1.
Figure 4:
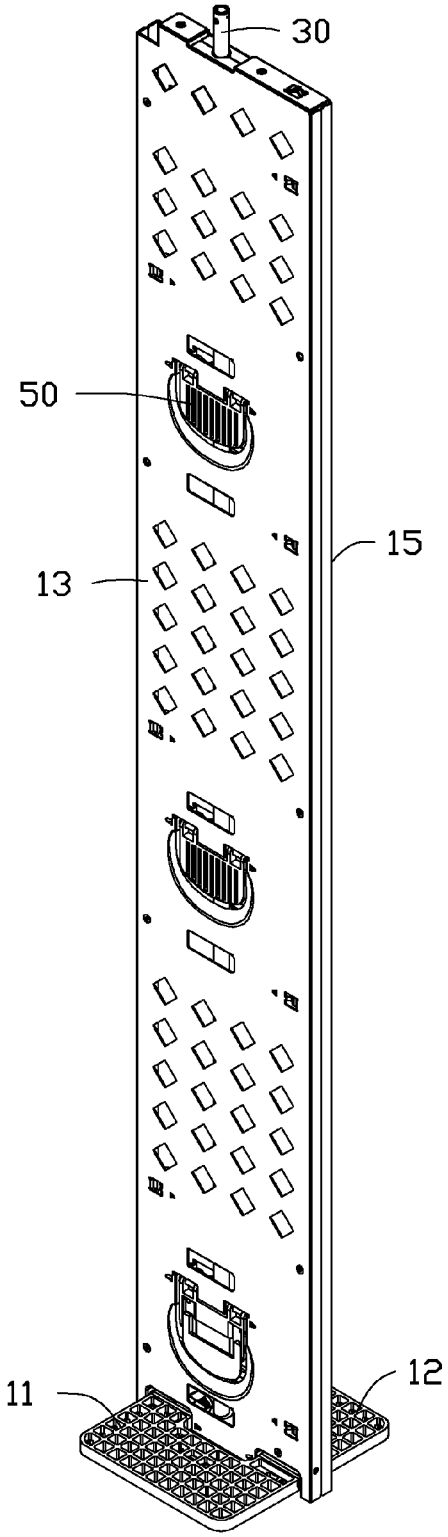
FIG. 4 is an assembled, isometric view of the control device of FIG. 1, with a shaft in an initial position.

FIG. 2 and FIG. 3 show that in assembly of the blocking plate 50 to the first mounting plate 131, the blocking plate 50 is placed in the first opening 135, and the positioning portion 52 is located in the pair of the first positioning pieces 136. The inserting portion 61 is inserted through the first positioning hole 1361 and the through hole 521 until the blocking portion 63 is blocked by the first protrusion 137. The bolt 60 is slid to elastically deform the first mounting plate 131, causing the blocking portion 63 to slide over the first protrusion 137 and the bolt 60 mounted between the first protrusion 137 and the first positioning piece 136. The first protrusion 137 prevents the bolt 60 from disengaging from the first positioning piece 136. The blocking plate 50 is similarly mounted to the second mounting plate 151. The first base 11 is rotatably mounted to the first pivoting piece 133. The second base 12 is rotatably mounted to the second pivoting piece 153. The shaft 30 is placed between the first frame 13 and the second frame 15 and is aligned with the first cutout 1321 and the second cutout 1521. The first frame 13 is secured to the second frame 15 by screws (not shown). The shaft 30 is pivotably received in the first cutout 1321 and the second cutout 1521. The shaft 30 is connected to a motor (not shown) which rotates the shaft 30. The tray 20 is located under the first base 11 and the second base 12. The mounting post 23 surrounds a bottom end of the shaft 30 and is rotatable together with the shaft 30. The first frame 13 and the second frame 15 are mounted in the casing 100 and located at a central position between the pair of second side plates 104. The first mounting plate 131 and the second mounting plate 151 are substantially parallel to the pair of second side plates 104.

Figure 5:
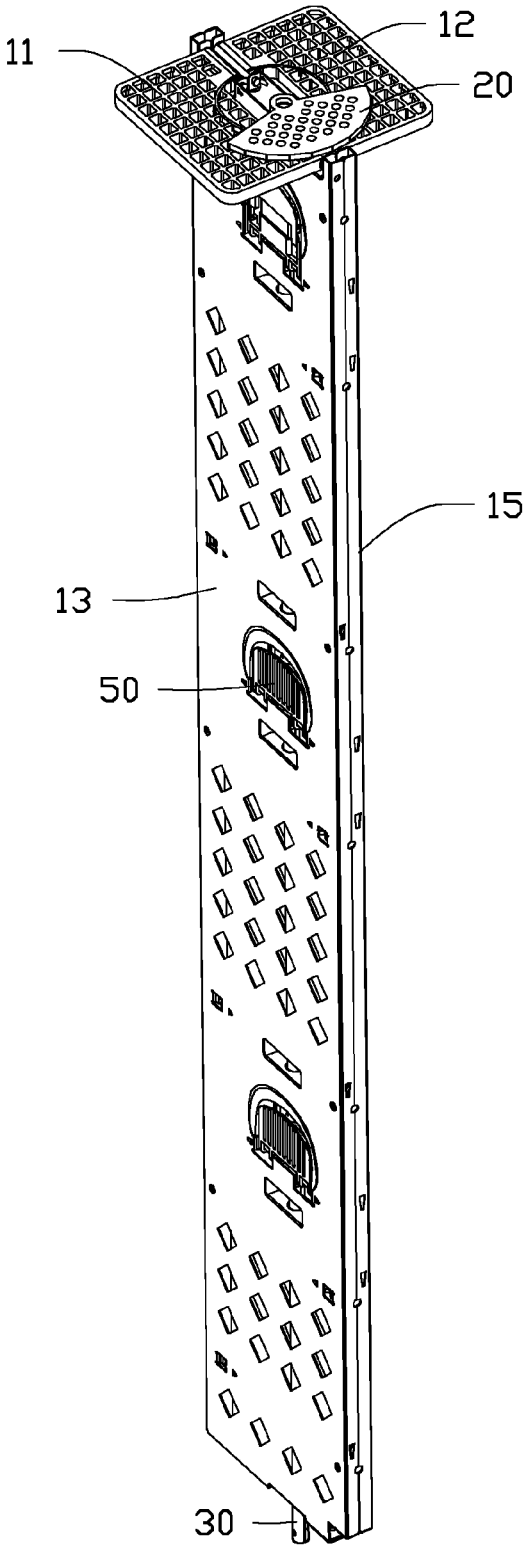
FIG. 5 is similar to FIG. 4, but viewed from a different aspect.
Figure 6:
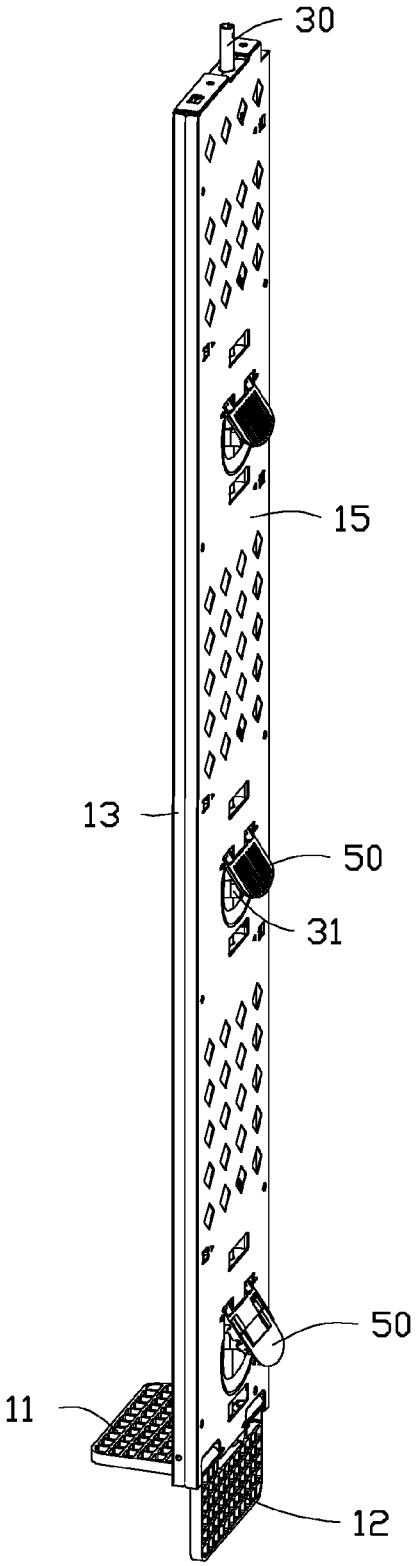
FIG. 6 is another assembled, isometric view of the control device of FIG. 1, with the shaft in a first working position.
Figure 7:
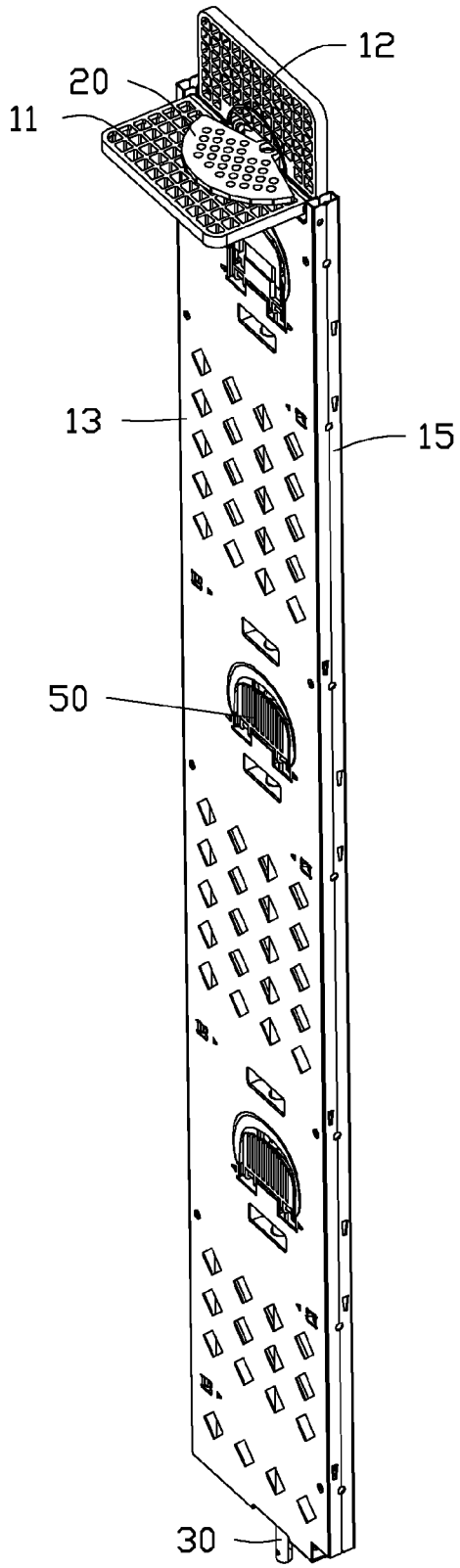
FIG. 7 is similar to FIG. 6, but viewed from a different aspect.
Figure 8:
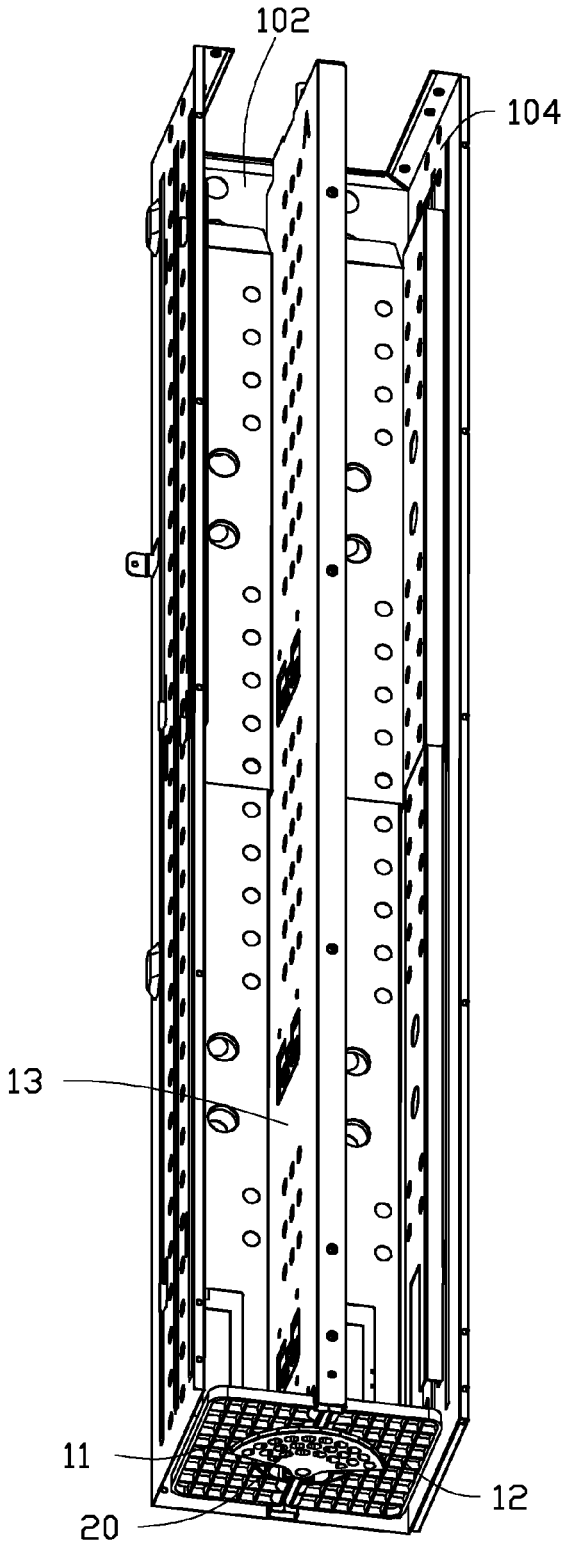
FIG. 8 is an assembled view of the dispensing assembly.
Figure 9:
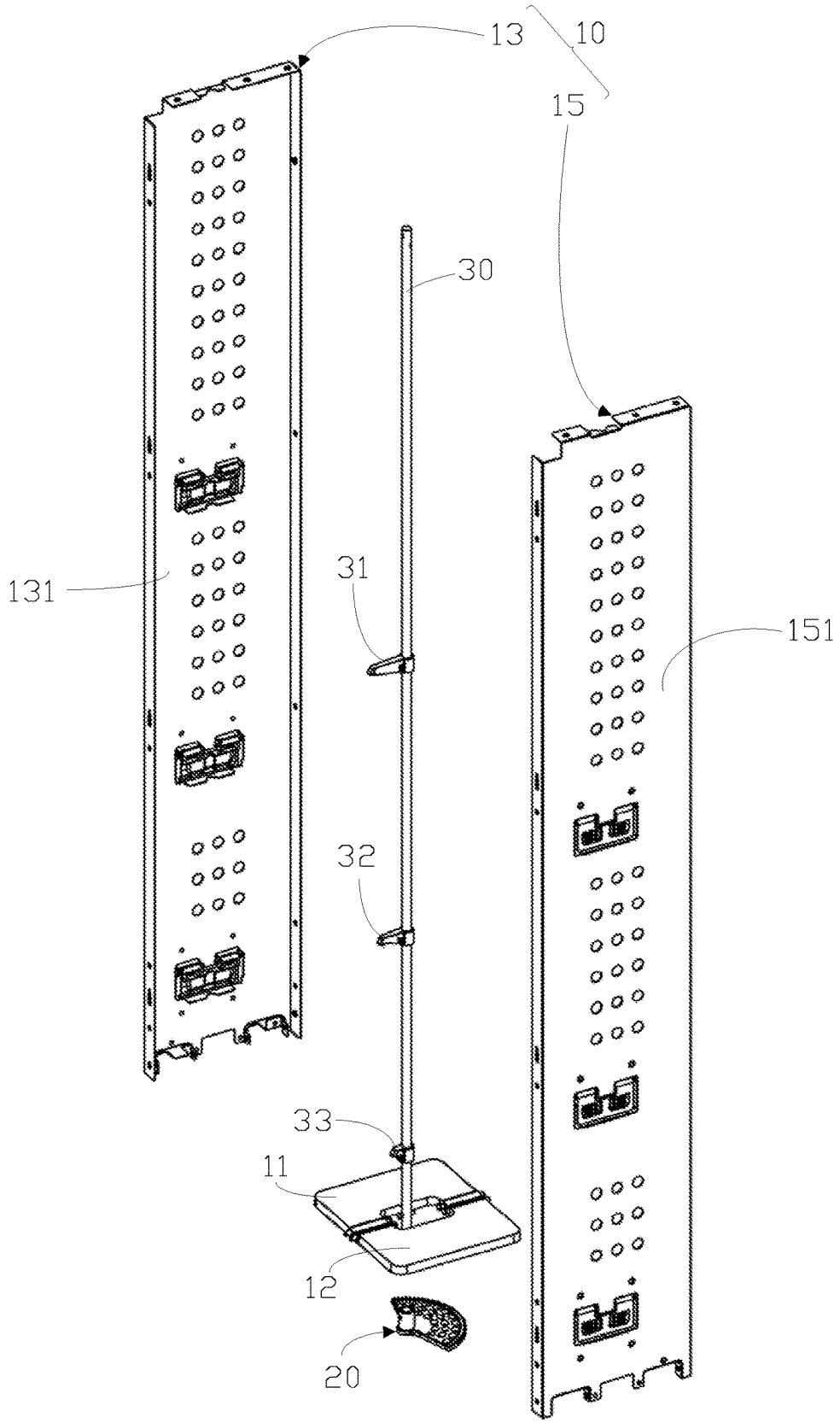
FIG. 9 is an assembled view of the dispensing assembly of FIG. 8 seen from another perspective.

FIGS. 5-7 show that, in use, a plurality of commodities (not shown) is placed one-by-one, on the first base 11 and on the second base 12. The shaft 30 is rotatable between an initial position and a first working position. The shaft 30 is further rotatable between the initial position and a second working position. When the shaft 30 is in the initial position, the first jacking member 31, the second jacking member 32, and the third jacking members 33 are between the first mounting plate 131 and the second mounting plate 151. The plate body 151 is received in the first opening 135 or the second opening 155, and the tray 20 holds the first base 11 and the second base 12 simultaneously, preventing the first base 11 and the second base 12 from rotating relative to the first frame 13 and the second frame 15. Thus, before a purchase is made, one of the items cannot drop down from the first base 11 and the second base 12.

When the shaft 30 is in the first working position, the tray 20 is rotated over the second base 12 and holds the first base 11 in place. At the same time, the first jacking member 31, the second jacking member 32, and the third jacking member 33 extends out of the first openings 135 and jacks the blocking plates 50 from the first mounting plate 131. Each of the blocking plates 50 attached to the first frame 13 is rotated outwardly to a slanting position relative to the first mounting plate 131. In this position, the blocking plates 50 and one of the pair of second side plates 104, which faces the first mounting plate 131, can hold the items located above the first base 11. Lengths of the first jacking member 31, the second jacking member 32, and the third jacking member 33 are different from each other. Slanting angles of the blocking plates 50 attached to the first frame 13 are different from each other. Thus, the blocking plates 50 can hold items with different sizes.

When the shaft 30 is in the second working position, the tray 20 is rotated over the first base 11 and holds the second base 12 in place. At the same time, the first jacking member 31, the second jacking member 32, and the third jacking member 33 extend out of the second openings 155 and lift the blocking plates 50 from the second mounting plate 151. Each of the blocking plates 50 attached to the second frame 15 is rotated outwardly to a slanting position relative to the second mounting plate 151. In this position, the commodities located above the second base 11 can be held by the blocking plates 50 and the other one of the pair of second side plates 104, which faces the second mounting plate 151.

It is to be understood, however, that even though numerous characteristics and advantages have been set forth in the foregoing description of embodiments, together with details of the structures and functions of the embodiments, the disclosure is illustrative only and changes may be made in detail, especially in the matters of shape, size, and the arrangement of parts within the principles of the disclosure, to the full extent indicated by the broad general meaning of the terms in which the appended claims are expressed.

What is claimed is:

1. A dispensing assembly, comprising:

at least one mounting plate with a plurality of openings arranged in a row along a first direction;

a rotatable shaft located adjacent to the at least one mounting plate, an axis of the rotatable shaft being substantially parallel to the first direction;

a plurality of blocking plates pivotably attached at edges of the plurality of openings; and a plurality of jacking members attached to the rotatable shaft, wherein each of the plurality of jacking members protrudes from the shaft along a second direction which is substantially perpendicular to the axis of the shaft; lengths along the second direction of the plurality of jacking members are different from each other; when the shaft is rotated to an initial position, the plurality of jacking members disengage away from the plurality of blocking plates, and the plurality of blocking plates are received in the plurality of openings; when the shaft is rotated to a working position, the plurality of blocking plates is rotated out of the plurality of openings to positions slanted relative to the at least one mounting plate by the plurality of jacking members, and slanting angles of the plurality of blocking plates relative to the at least one mounting plate are different from each other.

2. The dispensing assembly of claim 1, wherein the plurality of jacking members comprises a first jacking member, a second jacking member located below the first jacking member, and a third jacking member located below the second jacking member; and the second jacking member is located at a central portion between the first jacking member and the third jacking member.

3. The dispensing assembly of claim 2, wherein the length along the second direction of the second jacking member is less than the length of the first jacking member, but greater than the length of the third jacking member.

4. The dispensing assembly of claim 3, wherein the plurality of jacking members is substantially parallel to the at least one mounting plate when the rotatable shaft is in the initial position, and the plurality of jacking members is substantially perpendicular to the at least one mounting plate when the rotatable shaft is in the working position.

5. The dispensing assembly of claim 4, wherein the rotatable shaft is substantially parallel to the at least one mounting plate, the length along the second direction of the third jacking member is greater than a distance between the shaft and the at least one mounting plate when the rotatable shaft is in the working position.

6. The dispensing assembly of claim 1, wherein at least one limiting piece extends substantially perpendicularly from an inner side of the at least one mounting plate, and a cutout is defined in the at least one limiting piece for receiving the rotatable shaft.

7. The dispensing assembly of claim 6, wherein the cutout is semicircular.

8. The dispensing assembly of claim 1, wherein at least one pair of positioning pieces extends from upper edges of each of the plurality of openings, and each of the plurality of blocking plates comprises a plate body and at least one positioning portion extending from the plate body, and the at least one positioning portion is located between the at least one pair of positioning pieces.

9. The dispensing assembly of claim 8, wherein a through hole is defined in the at least one positioning portion, a positioning hole is defined in each positioning piece, and a bolt extends through the positioning hole and the through hole for pivotably attaching each of the plurality of blocking plates to the at least one mounting plate.

10. The dispensing assembly of claim 9, wherein the bolt comprises an inserting portion and a blocking portion wider than the inserting portion; the inserting portion extends through the positioning hole and the through hole; and the blocking portion is located outside of the at least one pair of positioning pieces.

* * * * *